United States Patent [19]

Späth

[11] Patent Number: 4,941,338

[45] Date of Patent: Jul. 17, 1990

[54] DEVICE FOR COLD FORMING OF FERROUS AND NON-FERROUS METAL SECTIONS

[75] Inventor: Walter Späth, Radolfzell, Fed. Rep. of Germany

[73] Assignee: Spath GmbH & Co. KG, Steisslingen, Fed. Rep. of Germany

[21] Appl. No.: 180,865

[22] PCT Filed: Jun. 2, 1987

[86] PCT No.: PCT/EP87/00284

§ 371 Date: Mar. 18, 1988

§ 102(e) Date: Mar. 18, 1988

[87] PCT Pub. No.: WO87/07537

PCT Pub. Date: Dec. 17, 1987

[30] Foreign Application Priority Data

Jun. 4, 1986 [DE] Fed. Rep. of Germany ..... 3618701

[51] Int. Cl.[5] ..... B21D 7/04

[52] U.S. Cl. ..... 72/151; 72/153; 72/155

[58] Field of Search ..... 72/64, 149, 150, 151, 72/153, 155, 157, 158, 296, 297, 306

[56] References Cited

U.S. PATENT DOCUMENTS

| | | | |
|---|---|---|---|
| 2,713,376 | 7/1955 | Bath | 72/298 X |
| 2,806,506 | 9/1957 | Yurka | 72/151 X |
| 2,945,529 | 7/1960 | Hein | 72/151 |
| 2,988,127 | 6/1961 | Gray | 72/158 X |
| 3,155,139 | 11/1964 | Hautau | 72/151 X |
| 4,481,803 | 11/1984 | Dieser | 72/150 |

FOREIGN PATENT DOCUMENTS

| | | | |
|---|---|---|---|
| 2910174 | 9/1980 | Fed. Rep. of Germany | 72/157 |

*Primary Examiner*—E. Michael Combs

*Attorney, Agent, or Firm*—Nilsson, Robbins, Dalgarn, Berliner, Carson & Wurst

[57] ABSTRACT

In the process for the cold forming of ferrous and non-ferrous metal sections, pretensioning is applied to the initially essentially straight metal section, which is clamped at both ends. Next, the tensioned metal section is bent in a rotating bending tool. In order to achieve three-dimensional forming of the metal section, the bending tool effects a controlled movement in all three spatial axes, whereby the metal section is pressed, with a backlash-free guide system, at least in the forming region against the bending tool and guided by positive engagement.

13 Claims, 6 Drawing Sheets

DEVICE FOR COLD FORMING OF FERROUS AND NON-FERROUS METAL SECTIONS

BACKGROUND OF THE INVENTION

The invention relates to an apparatus for cold bending pretensioned ferrous and non-ferrous metal sections.

A known apparatus for bending metal sections is disclosed in the German patent No. DE-34 04 641A1 from the same inventor. It is characteristic of this apparatus that the initially straight metal section is adjustably tensioned and that then the tensioned metal section is subjected to rotary bending.

The rotary bending is achieved by pressing a feed rail die with adjustable force against the underside of the metal section, whereby the rotating tool attached to at least one end of the metal section exerted a rotational movement, i.e., a winding movement, and that the tensioned metal section wound around the external perimeter.

With this known apparatus, it was possible for the first time to cold form large and small volume, thin and thick walled sections, with the possibility of bending sections of any shape with a high degree of accuracy in one plane. The basis for the known apparatus is the knowledge that the pretensioning constantly applied during forming equals the shear stress generated in the section during bending and assures a nondeforming bend. An additional advantage is achieved by means of the die rail pressed against the underside of the section during forming in that the coarse grain structure obtained by exceeding the elastic limit of the billet during forming is compressed back to fine grain structure. The forming is thus a type of cold forging which contributes to a strengthening of the billet material during forming by bending. If in fact the coarse structure were retained, modifications of the properties of the material would be inevitable, such as, for example, increased tendency toward brittle fractures. Thus the structural conversion contributes to a reduction in the hardening of the material.

With the known apparatus it was, however, not possible to bend such sections on just any spatial axis; it was also not possible to produce three-dimensionally bent sections.

Furthermore, it was not possible with the known apparatus to form extrusion sections with an undercut groove or a hollow section without deformation of the groove or the hollow section after successful bending.

SUMMARY OF THE INVENTION

Therefore, the underlying object the invention is to enhance a device of the type mentioned in the beginning in such a way that sections of steel and nonferrous metals may be produced in any curved shape whatsoever, particularly cornu spirals or transition curves (i.e., a spiral curve with a continuously decreasing radius), rationally and with reliable shape, without deforming the particular cross-section of the section.

To meet the stated objective, the apparatus is distinguished by the fact that to achieve three-dimensional forming of the metal section, the bending tool exerts a controlled movement in all spatial axes and the section is pressed against the bending tool with a backlash-free guide system at least in the forming region and is guided by positive engagement.

An essential element of the present invention is thus that the bending tool exerts a controlled three-dimensional movement on all three spatial axes and that, at least in the forming region of the section, there is a backlash-free guide system oh the external side of the section, which engages the section positively and presses it against the bending tool. Thus, undesirable deformations of the cross-section of the metal section during bending are avoided. Thus, for the first time, thin and thick walled, large and small extruded, drawn, bent, or rolled metal sections or even hollow sections of steel or nonferrous metal sections can be bent in any spatial direction whatsoever without deformation. An advantageous embodiment of the present invention is the production of guide rail systems from aluminum sections. Such guide rail systems are used in motor vehicles to provide an aluminum extrusion section which is bent in several planes and sometimes also twisted with a guide slit along the groove of the extrusion section to guide the seatbelt. An additional embodiment applying the apparatus according to the invention is the production of window frames for motor vehicles with curved glass. In addition, there are many similar areas of application, e.g., the bending of chassis, body, or cabin spars for aircraft, cable railroads, and so forth.

With implementation of the apparatus proposed according to the invention the following advantages and characteristics are obtained:

Section forming without need for additional finishing;

Accurate production (up to ±1/10 mm tolerance for the cross-section of the section or up to ±1 mm overall dimensional tolerance);

A prerequisite is the provision of appropriate guide devices during spatial roller and stretcher bending;

Accurate operation with high repetition speed depending on the structure of the metal sections (size, thickness, shape, material);

Continuous transition of the individual forming planes;

Accurate forming, precisely chosen twists in the individual forming areas;

Availability of multiaxis control (continuous path control);

Modification of characteristics of the material through possible coarse-fine conversion during the forming process, especially decreasing the brittle fracture tendency and increasing inherent elasticity of the material; and Changing the spatial development of the movement by control programs.

For simplicity in the following, reference is always made to the forming of a metal section with an undercut groove. Of course, the invention also encompasses the forming of hollow sections—to which no further reference is made.

Thus, with the inventive apparatus, independence of cold forming at any point whatsoever of the section is achieved relative to the axis of formation, sectional geometry, and sectional cross-section. A practical embodiment of the apparatus provides that the groove of the section is filled in the region of a feed station with a link chain which virtually fills the cross-section of the groove, and that the section thus prepared is subjected to a spatial rolling, stretching, and bending and further, the three-dimensionally formed section is treated at a calibration station in such a way that a linked forming chain with calibration cores attached to it is drawn through the groove.

Thus the advantage is obtained that distortion-free, accurate section forming is achieved in any section whatsoever, especially in sections for guide rail systems.

With the inventive apparatus, various bending are merged into one, i.e., role bending, core bending, and core stretch bending, in multiaxis forming of sections.

Thus, accurate forming can be performed in the separate parts of the billet in all forming planes, even including twists.

In order to avoid undesirable deformation of the groove in the cross-section of the section, provision is made to move the link chain introduced into the section lengthwise in the groove at least one half the length of a link during the forming process to prevent the links from pressing into the groove and making dents in the walls of the groove or in the interior of the section.

With the implementation of a bending tool which can be moved for control in all three spatial axes, there are many varying possibilities. All possibilities which are described below and which result from the combination of the examples described below as well as those dealing with obvious modifications are included in the protection of the present invention.

A first embodiment of a device for performing the process provides that the bending tool consists of a rotary table which can be moved under control in all three spatial axes, upon which a form block is attached, the external perimeter of which basically matches the three-dimensional bend line of the finished bent section, that a clamping element is also attached to the rotary table for one-ended pretensioning of the section, and that the other end of the section is held by a tension clamp fastened to the frame of the machine.

The form block does not absolutely have to correspond exactly to the finished three-dimensional bend line of the finished bent section, since the bend radii can be set by the form block to allow for subsequent springback of the finished bent sectional bar.

Of critical importance in preventing excessive deformation of the section and especially deformation of the cross-section of the groove is the fact that at least in the forming region of the section opposite the form block of the rotary table and radially to the rotary table, one or several die rollers are adjustably attached, whose movement can also be controlled in synchronization with the controlled three-dimensional movement of the rotary table.

Thus, this is a backlash-free directed guiding system designed to grip the section as positively as possible at least in the forming region to prevent excessive deformation of the section during bending. The prior art contact pressure die rail is thus replaced according to the invention by one or several die rollers which results in pressing the section against the form block of the rotary table in the forming region in synchronization with the movement of the rotary table.

A first group of embodiments according to the present invention provides that the synchronous pressing of the die rollers in the forming region of the section against the form block of the rotary table results from the fact that the die roller is connected to the rotary table and therefore moves in synchronization with all the movements of the rotary table.

A second group of embodiments provides that the movements of the die rollers are controlled independently from the movements of the rotary table by a separate control system, i.e., that the die roller and the rotary table can be controlled independently of one another. This also implies the capability of not merely moving the die roller and the rotary table in synchronization with each other, but also, for example, the capability of tilting the die roller relative to the plane of the rotary table and pressing it in this position against the section to be bent.

To assure nondeformed bending of the section in the forming region, provision is made that the external perimeter of the die rollers positively engages at least a part of the section and that the part of the cross-section of the section not engaged by the die rollers is positively engaged by the shape of the form block. For simplicity, the following description assumes only one die roller, although the basic design of the invention includes any arrangement whatsoever of several die rollers, which can be located either on one side (as described) or on the opposite side of the section.

That means that at least in the forming region, the metal section is positively engaged on all sides, i.e., completely bounded by coordinated dies. This bounding is effected on the one side by the shape of the form block, while the remaining part is bounded by the shape of the die roller. Since the die roller can be variably adjusted against the form block under great force, dents and other undesirable deformations of the section are reliably prevented in the forming region.

The section can thus be formed with the given technical knowledge somewhat like a "roller coaster." In addition provision is made that in predetermined parts of the section the section can also be controllably twisted (rotated); this is preferably achieved by taking advantage of the fact that the tension clamp fastened to the movable die rail to which the die roller is attached can be rotated. Control of the movement of the rotary table in all three planes likewise occurs in several different embodiments. Basic to all embodiments is the idea that the pivot point of the rotary table must always lie in the neutral center of the metal section and, furthermore, that the die roller bounding the section in the forming region must lie as nearly as possible in true alignment with the pivot axis of the rotary table.

Thus, undesirable deformations during bending are avoided

Since the entire rotary table is rotatable relative to the frame of the machine by at least 180° on two horizontal axes perpendicular to each other, the special advantage is obtained that not only three-dimensionally positive radii are bendable but also negative radii, so that a "serpentine section" with alternating reversed bending directions can be formed. For this, the positive radius is first bent three-dimensionally on the rotary table. Then, the metal section is freed at one end from the tension clamp, and the entire rotary table is rotated by 180° from its initial horizontal axis (e.g., lengthwise in the direction X), after which the end of the section is again clamped in the tension clamp, the pretensioning again applied and then, by rotational movement of the rotary table, the now positive—but formerly negative—radius is bent over an inserted form block core. It is likewise possible to then rotate the rotary table by 180° from its second horizontal axis (e.g., lengthwise in the direction Y), after which the end of the metal section is again clamped and then, by rotational movement of the rotary table, yet another positive—but formerly negative—radius is bent. Instead of rotating the rotary table by 180° in the X and/or Y directions, it is also possible to turn the section by 180° on the unrotated rotary table and to clamp it to the rotary table in the turned shape, introducing the bending form block necessary in this case from the magazine.

The object of the present invention is not merely the result of the individual patent claims, but is also the result of the combination of the individual claims.

All data and characteristics made public through the documents, in particular the spatial form shown in the drawings are claimed as basic to the invention to the extent that they are new, individually or in combination, relative to the prior art.

BRIEF DESCRIPTION OF THE DRAWINGS

In the following the invention is illustrated in greater detail by means of sketches presenting several embodiments. In this, additional characteristics and advantages of the invention emerge through the sketches and their description.

The figures show.

DESCRIPTION OF THE PREFERRED EMBODIMENTS

Figure 1:
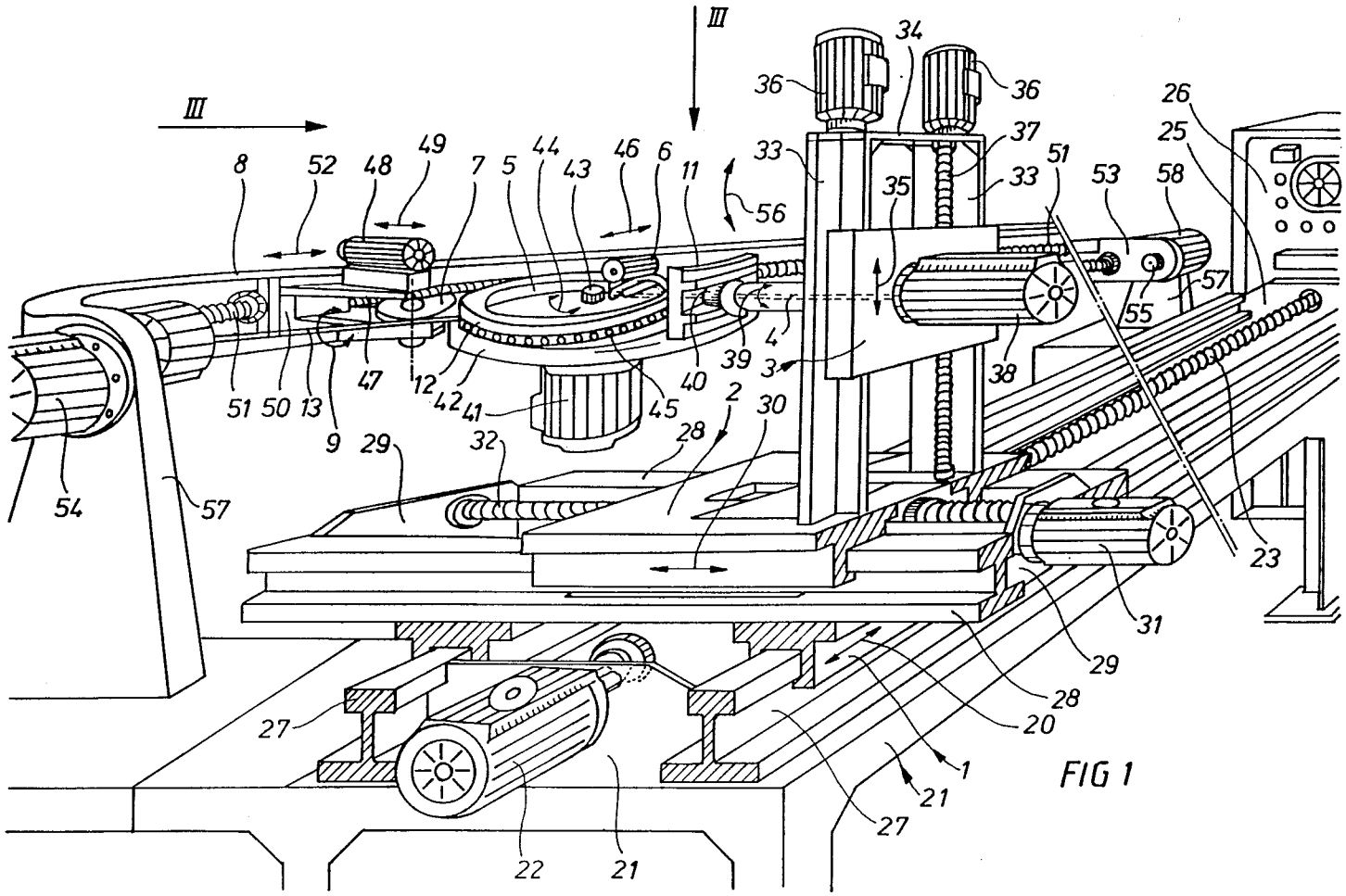
FIG. 1: perspective view of a device for performing the process in a first embodiment.
Figure 2:
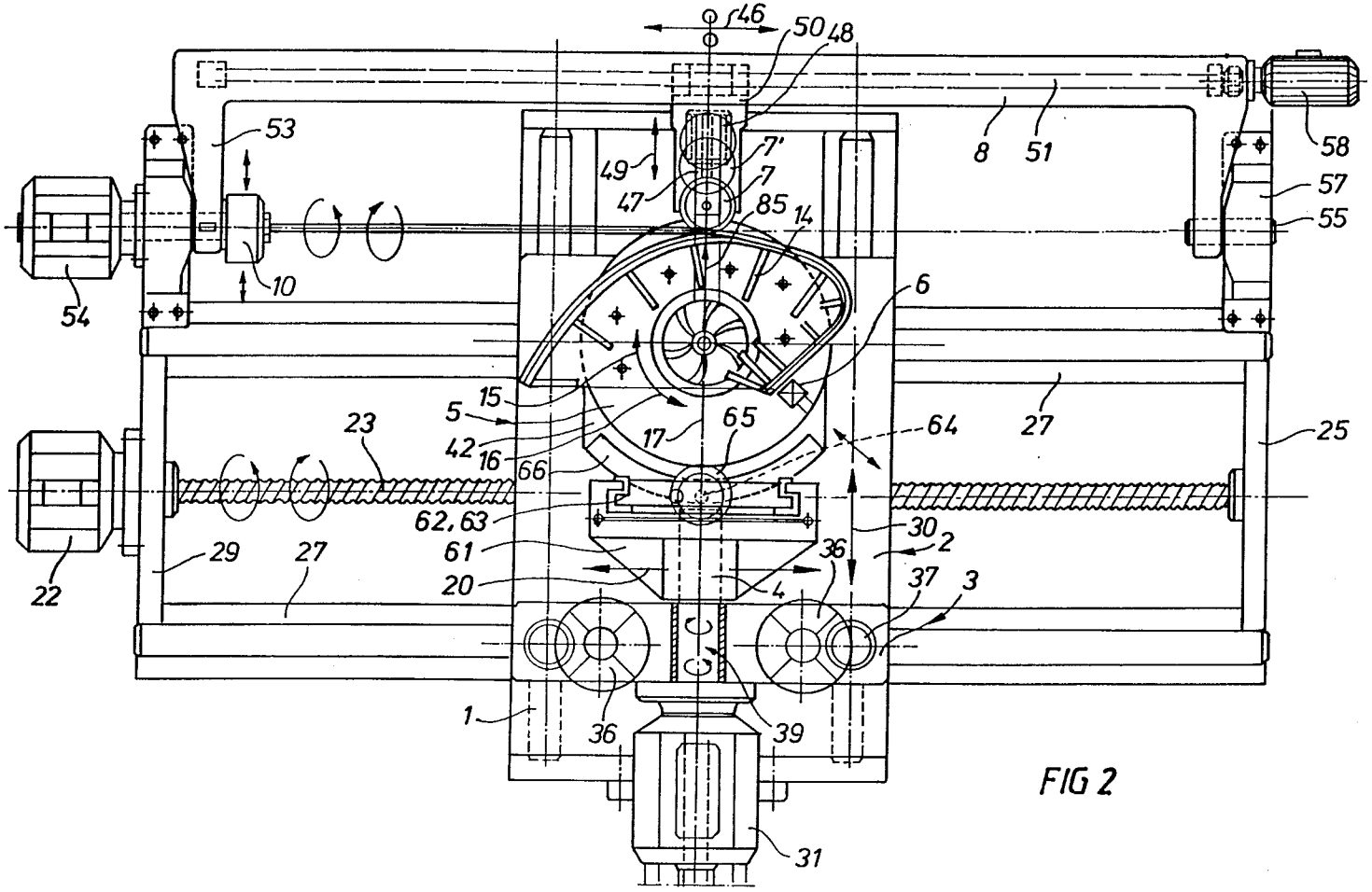
FIG. 2: a top view of the device according to FIG. 1 in the direction of the arrow II in FIG. 1, FIG. 3: an end view of the device according to FIG. 1 in the direction of the arrow III in FIG. 1, FIG. 4: a schematic sketch of an embodiment modified relative to the embodiment in FIG. 1 through 3, FIG. 5: a perspective view of an embodiment modified relative to the previous embodiments.
Figure 3:
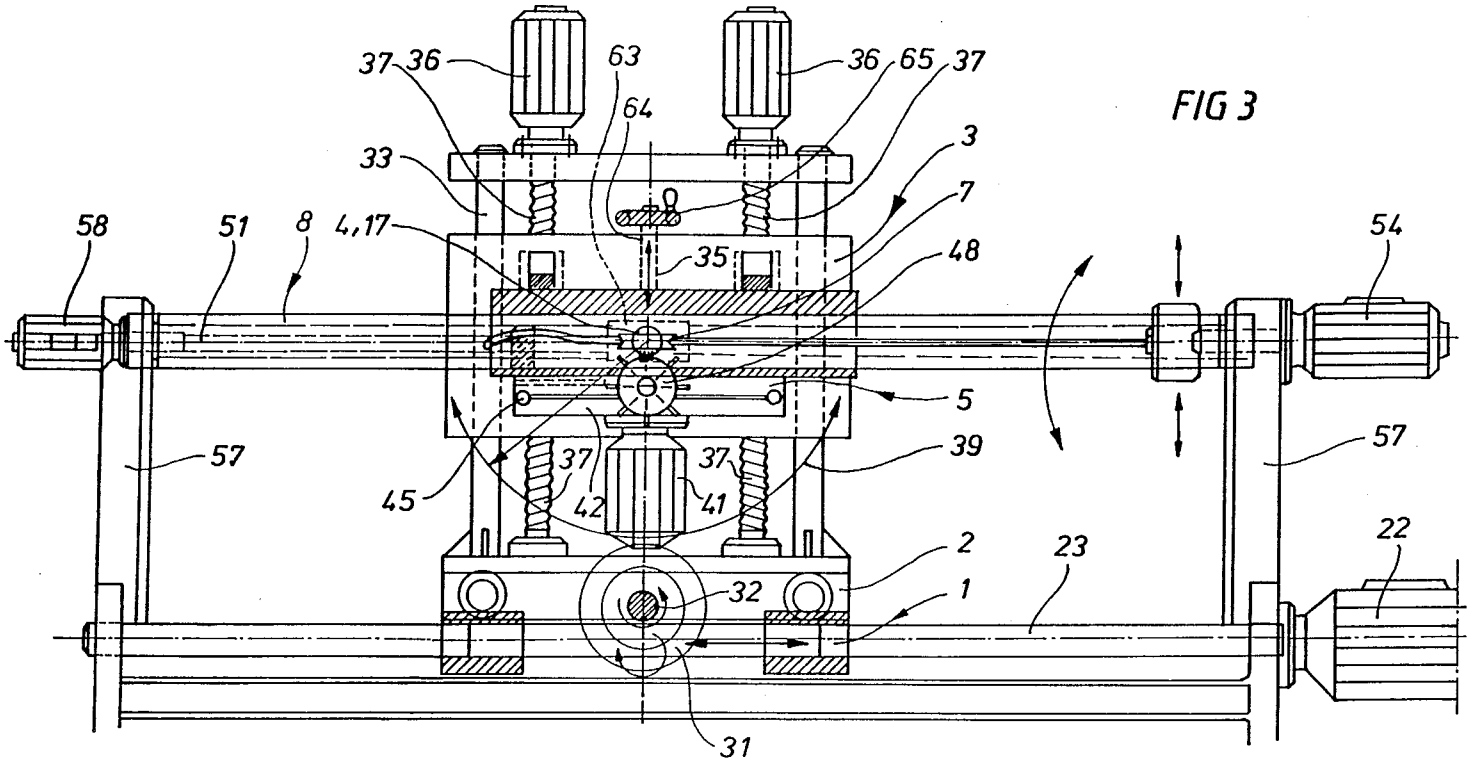

FIG. 1 through 3 show a longitudinal slide 1 movable in direction X (direction of arrow 20) on a machine frame 21. Parallel guide rails 27 positioned at a distance from each other, upon which the longitudinal slide 1 is movable longitudinally along the guide rails 27, are provided on the machine frame 21. The movement is possible because the guide rails are respectively connected on the end by cross rails 24, 25 (cross rail 24 is marked 29 in FIG. 2), and a drive motor 22 which drives a spindle 23 is attached to one cross rail 24; the spindle 23 is attached to the opposite cross rail 25 in such a way that it can turn. The spindle passes through a spindle nut located in the longitudinal slide 1, thus making the longitudinal slide 1 movable in the direction of the arrow 20 mentioned.

The longitudinal slide 1 is in turn provided with parallel guide rails 28 spaced opposite each other upon which is located a cross slide 2 movable in direction Y (direction of arrow 30).

Movement of the cross slide 2 is handled in the same way as previously described for longitudinal slide 1, i.e., the two guide rails 28 are respectively connected by cross rails 29, and a drive motor 31 which serves a spindle 32 is attached to one cross rail 29; the spindle is attached to the opposite cross rail 29 in such a way that it can turn. The spindle likewise passes through a spindle nut in the cross slide 2.

The cross slide 2 bears a vertical slide which is movable in the direction Z (direction of arrow 35). For this, two parallel vertical guide rails 33 are spaced opposite each other on the cross slide 2; the guide rails 33 are connected on the top by a cross rail 34. Two parallel drive motors 36, each of which drives a spindle 37, are attached to the cross rail 34; each spindle 37 passes through a spindle nut—not shown—in the vertical slide 3. The spindles 37 are attached to the cross slide 2 in such a way that they can turn.

The vertical slide 3 bears a pivot drive for the bending tool. The pivot drive consists of a drive motor 38, which is attached to the vertical slide 3 and drives a shaft 4 which is can be rotationally driven in the direction of arrow 39. The free, front end of the shaft 4 engages a stop block 42 of the bending tool via a flange 40. The bending tool itself consists of the stop block 42 to the bottom of which is connected a drive motor 41 whose shaft 43 drives a rotary table 5 upon which is mounted a form block 12 which basically corresponds to the shape of the finished bent section (section 13).

The specific forces applied to the form block in the region of critical bend radii and twisting result in the fact that the metal section 13 to be bent in these positions is overbent to compensate for the anticipated springback of the section after successful bending.

The rotary table 5 is mounted on the stop block 42 with bearings 45 so it can turn.

The rotary table 5 is driven by drive motor 41 so that it turns in the directions of arrow 44. On the top of rotary table 5 is a clamping element 6 which can be adjusted in and out in the directions of the arrow 46 radially to the shaft 43 in such a way that the free end of the metal section 13 is clamped with this clamping element 6, as shown in FIG. 2.

FIG. 2 shows that the form block 12 is in turn connected to the rotary table with appropriate support elements 14.

A comparison of FIGS. 1, 2, 3 further reveals that in the forming region 85 of the section 13, i.e., in the region where the maximum bending of the section against the form block 12 occurs, a die roller 7 is pressed against the form block 12 radially to the rotary table from the outside, with the die roller 7 always held in positive contact with the section 13 in the forming region 85 via an appropriate drive controlled in all three spatial axes.

For this the die roller 7 is mounted in a first internal slide 47 in such a way that it can turn, with the slide 47 adjustable in and out radially to the center of the rotary table in the directions of the arrow 49. The slide 47 is mounted so that it can slide in the directions of arrow 49 in a larger slide 50, with the slide 50 in turn held in a die rail 8 in such a way that it can move in the directions of the arrow 46.

As shown in FIG. 2, the die rail 8 is essentially U-shaped, with a spindle 51 passing through the entire length of the die rail in the region of the bottom of the U; the spindle 51 passes through the slide 50 and there engages a spindle nut—not shown. The spindle is driven rotationally by a drive motor 58 which is attached on the exterior of the die rail 8. Thus, the slide 50 and along with it the die roller 7 can be moved in the direction of arrow 46, while a transporting motor 48 on the slide 50 takes care of the movement of the die roller 7 in the directions of the arrow 49.

The two opposing sides of the U-shaped die rail 8 are attached to the machine frame 21 so they can pivot in the region of pivot bearings 55 aligned with each other, with the pivot bearings 55 included in the attached pedestals 57, which are in turn connected to the machine frame 21.

FIG. 1 through 3 further show that the end of the section 13 opposite the clamping element 6 is held by a tension clamp 10 which is in turn mounted so that it can turn by means of a torsion motor on the die rail 8, which is in turn mounted so it can pivot on the sides of the U 53 in the region of the pedestals 57. By twisting the tension clamp 10, the section 13 is twisted in the directions of arrow 9 and this occurs before it reaches the forming region 85, i.e., the space between the die roller 7 and the form block 12.

All drive motors and torsion motors shown here are controlled from a control console 26 which is shown by way of example in FIG. 1.

The die rail 8 can be pivoted around its pivot bearings 55 in the directions of arrow 56 so that the die roller 7 can follow all the movements of the rotary table 5.

The necessary pressure contact of the die rail 8 against the form block 12 in the forming region 85 is generated in the directions of the arrow 49 via the transporting motor 48.

FIG. 1 through 3 show two different embodiments of the pivotal drive of the rotary table 5.

FIG. 1 shows, as a first embodiment example, that the drive motor 38 for the rotational drive of the rotary table 5 is seated on the vertical slide 3 and that the shaft 4 of this drive motor 38 acts directly without the intermediary of a leveling device 11 on the stop block 42 of the rotary table 5.

In another embodiment, not further shown in the drawings, provision can be made for the vertical slide 3 to be omitted completely. The vertical slide 3 shown in FIG. 1 may then be considered as a stationary plate connected immovably to the guide rails 33. The drive motor 38 with its shaft 4 is then connected to this plate, and a leveling device 11 is then provided between the free end of the shaft 4 and the stop block 42 of the rotary table 5.

This leveling device 11 is further illustrated in a simple design embodiment in FIG. 2 and 3.

Reference is also, however, made to the fact that both the vertical slide and the leveling device 11 may be present; but it is equally possible to use the leveling device 11 without the vertical slide 3.

However, FIG. 2 and 3 show the use of both elements, i.e., the vertical slide 3 and the leveling device 11.

The leveling device 11 replacing the vertical slide 3 consists as shown in FIG. 2 of a guide piece 61 connected solidly (so as not to rotate) to the free end of the shaft 4 forming a holding fixture 62 on its front end. In the embodiment example shown, this holding fixture is designed as a vertically dovetailed guide in which a guide block 63 is vertically movable (on the vertical axis Z). The guide block 63 is solidly connected via a connecting element 66 with the stop block 42 of the rotary table 5.

The vertical adjustment of the guide block 63 in the holding fixture 62 is accomplished in the embodiment example shown by means of a simple handwheel 65 connected to a spindle 64, with the handwheel and the spindle rotatably mounted on the guide piece 61 and the spindle passing through a spindle nut—not shown—in the guide block 63.

By turning the handwheel 65, the guide block 63 is moved vertically.

The reason for this movement is that the rotary table is first vertically set in a neutral middle position and that then the bending process proceeds from the middle position in the positive direction Z and in the negative direction Z.

Instead of the manually operated spindle 64, presented merely by way of example, provision is also of course made for driving the spindle 64 by means of an appropriate controllable drive motor.

It also goes without saying that all electric motor drives shown in the embodiment examples may be replaced by fluid drives.

Figure 4:
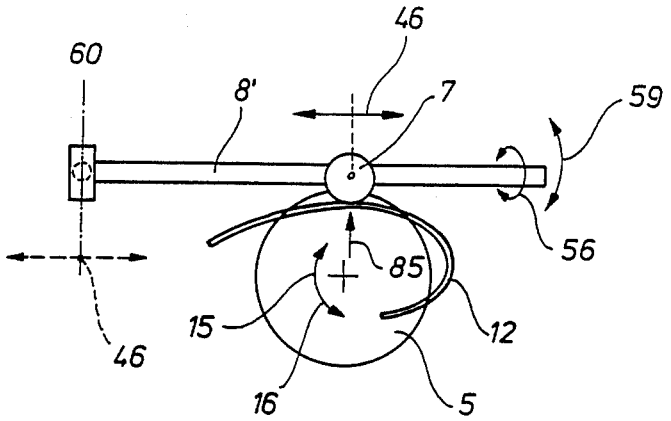

FIG. 4 is a schematic representation of a top view of an embodiment modified relative to the embodiment in FIG. 2.

There it can be seen that the rotary table 5 rotationally driven in the directions of the arrows 15, 16 bears a form block 12 and that a die roller 7 is provided in the forming region 85 opposite the form block 12; this die roller 7 is mounted in the region of a die rail 8′ in such a way that it can be moved in the directions of the arrow 46.

In contrast to the previously described embodiments, this die rail 8 can now be rotated on its longitudinal axis in the directions of the arrow 56 so that the die roller 7 can assume varying inclinations relative to the form block 12.

Furthermore, the die rail 8′ can however also be pivoted around a housed pivot bearing 60 in the directions of arrow 59. The die rail 8 is thus to be considered as a canted rail, which is mounted in the pivot bearing 60 in such a way that it can pivot.

FIG. 4 also shows as a variant that the die roller 7 does not absolutely have to be mounted on the die rail 8′ in such a way that it can be moved in the directions of arrow 46; it is equally possible instead in another embodiment to connect the die roller 7 solidly to the die rail 8 and to mount the pivot bearing 60 on the machine frame 21 in such a way that it can be moved in the directions of arrow 46.

Figure 5:
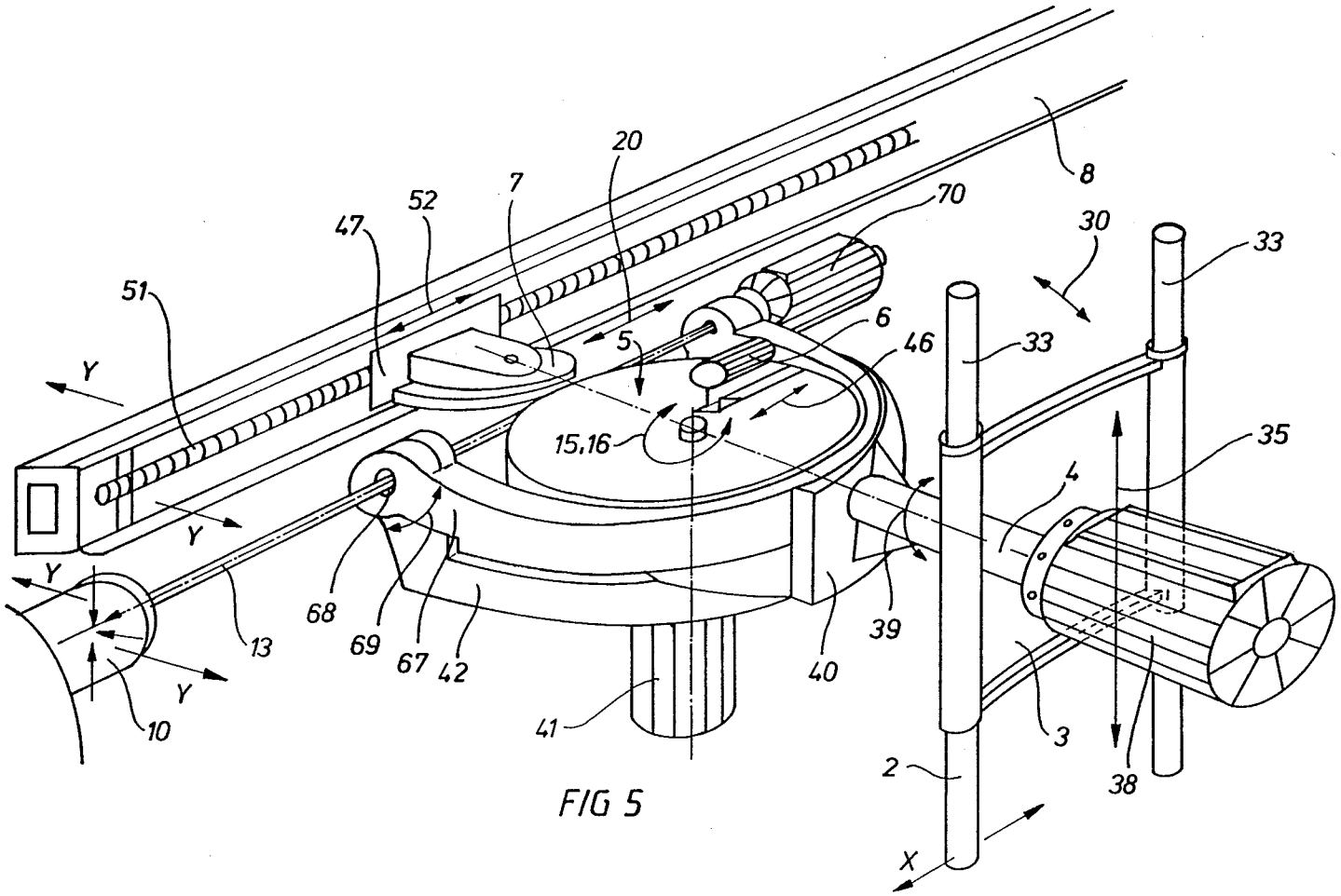

FIG. 5 shows an additional variant compared to the previously described embodiments.

For simplicity, it is omitted (from the drawing) that the vertical slide 3 is mounted in a longitudinal slide 1 (not shown) in such a way that it can be moved so that the drive motor 38 for turning shaft 4 can again effect movements on the two spatial axes (X, Z) because this drive motor 38 is mounted in a vertical slide 3 in such a way that it can be moved. The cross slide 2 is however omitted and the necessary Y-connection is replaced by a shifting of the entire die rail 8 and the tension clamp 10 in the direction Y. The shaft 4 which can be moved in the directions of arrow 39 sits on a flange 40 which is solidly attached to the middle section of a rocker 67. The rocker 67 has a semicircular shape with a pivot bearing in each of the opposing ends which are aligned with each other, and the stop block 42 of the rotary table 5 is mounted in these pivot bearings opposite each other in such a way that it is movable in the pivot direction 56 (see FIG. 1). The pivoting of the stop block 42 relative to the rocker 67 is accomplished by a pivot motor 70, which moves the stop block 42 around the pivot bearings 68 in the directions of the arrow 69. The pivoting around the shaft 4 then occurs in the directions of the arrow 39 perpendicular to this rotational movement in the directions of the arrow 69, thus moving the rocker 67. Between the rocker 67 and the flange 40 is located the leveling device 11 previously described using FIG. 1 and 2, which is not shown in the drawing for simplicity.

Furthermore FIG. 5 shows that the die roller 7 is mounted in a slide 47 in such a way that it can be rotated; the slide 47 is arranged so that it can be moved longitudinally in the directions of the arrow 52 in a die rail 8 which can be moved in the direction Y. The longitudinal movement is accomplished with the same arrangement as that shown in FIG. 2, i.e., that a spindle 51 is mounted in the longitudinal axis of the die rail 8 in such a way that it can be rotated; the spindle 51 passes through a spindle nut provided in slide 47. When the spindle 51 is rotated by the drive motor 58 (FIG. 2), the slide 47 is moved back and forth by it in the directions of arrow 52. The die roller 7 always positively engages the external perimeter of the form block 12 which is placed on the rotary table 5; for this, an additional transporting motor 48 (not shown in FIG. 5) with a slide connected to it can be provided, as described using FIG. 1 and 2.

Thus, movement for the die roller 7 in the directions of arrow 49 toward the rotary table is provided for. To prevent tilting of the die roller 7 relative to the rotary table, provision can be made for the rotational axis of the die roller 7 itself to be pivotable around a horizontal axis (Y axis) in slide 47.

Figure 6:
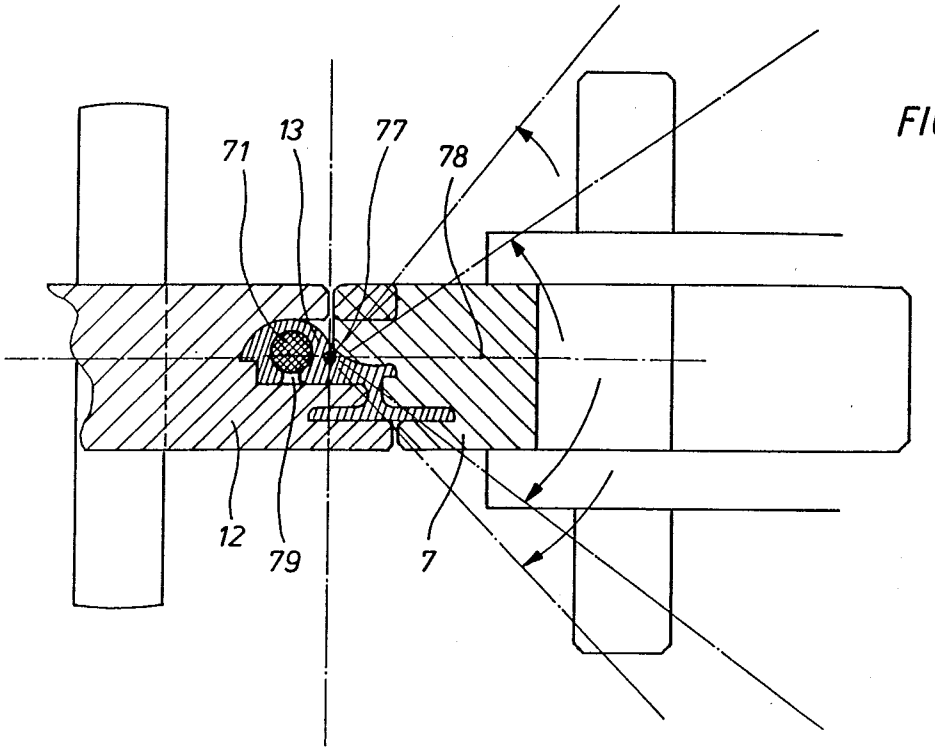
FIG. 6: a cross-section through the forming region with partial representation of the form block with the die roller.

FIG. 6 is a schematic representation of a cross-section through the form block 12 and through the opposing part of the die roller 7 in the forming region 85.

It can be seen from the drawing that the section 13 is positively held by both a shaped holding fixture on the external perimeter of the form block 12 and by the shaped holding fixture on the external perimeter of the die roller 7. Positive engagement of the section 13 in the die roller 7 and the form block 12 guarantees that the section cannot bulge or buckle on any side or surface during the forming process.

It can also be seen that the forming center 77, which lies roughly in the geometric center of section 13, has to lie in the forming plane 78 (i.e., the longitudinal bisecting plane through the form block and the die roller) and that also a link chain 71 is drawn into the groove 79 to prevent deformation of the groove and the walls of the groove during forming.

Figure 7:
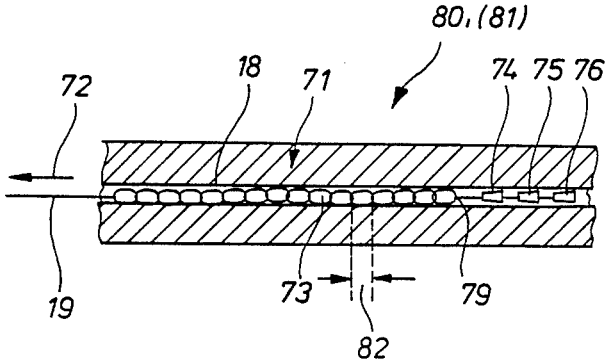
FIG. 7: a top view of a grooved section with link and calibration chain inserted in the groove.

FIG. 7 shows, by way of example, the top view of the groove 79, with the link chain 71 only shown schematically. For improved clarity the groove 79 is cut away so that the underlying larger profile of the groove 18 is visible. This groove profile 18 is completely filled by the individual links 73 of the link chain 71 with all links 73 connected to a pull chain 19.

Several calibration cores 74–76 are located on the end of the link chain 71. These calibration cores provide for final dimensional accuracy of the groove after successful forming.

The calibration core 74 which immediately follows the last link of the link chain 71 has a smaller diameter that the calibration core 75 immediately following it, and this in turn has a smaller diameter than the final calibration core 76 which follows it.

After successful forming of the groove 18 [79], i.e., after completed three-dimensional bending of the section 13, for final dimensional accuracy of the groove profile 18 and of the groove 79, the pull chain 19 is drawn through the groove profile 18 in the direction of arrow 72, with the first calibration core 74 spreading the groove slightly, the calibration core 75 spreading it further, and the final calibration core 76 spreading the groove definitively into the prescribed dimension. Thus, smooth, continuous transitions are made in the region of the groove profile 18.

It is also important that during the forming process the link chain 71 is moved slightly, e.g., by the length 82 of a link in the direction of arrow 72, to prevent the individual links 73 from deforming the walls of the groove profile 18.

Figure 8:
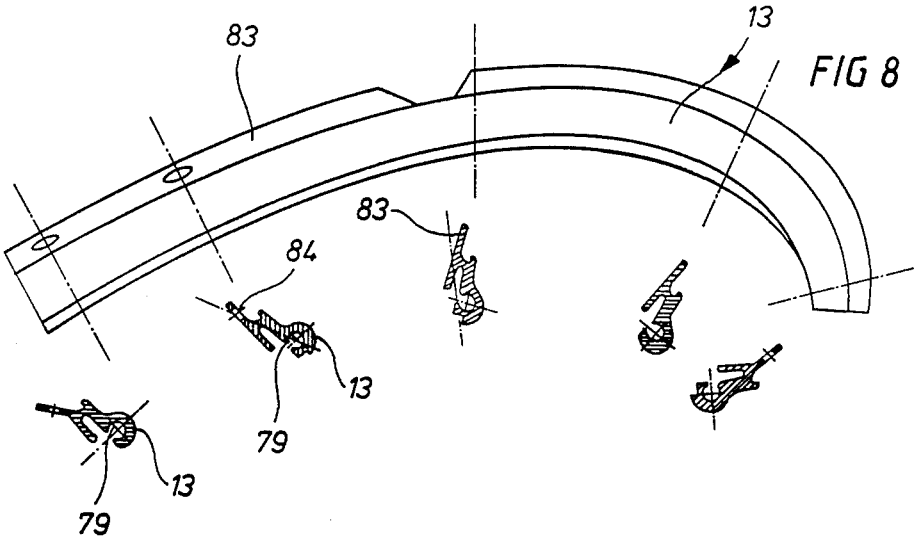
FIG. 8: a top view of a section with cross-sections through the section to show the twist.

FIG. 8 shows, by way of example, the top view and cross-sections through a three-dimensional section 13 according to the invention.

The section 13 consist of a roughly bow-shaped curved sectional strip with respective cross-sections of the section in the region of the individual cuts. To make it possible to attach the section to an appropriate mounting surface, mounting flanges 83 are formed with mounting holes 84 in them. It can be seen from the cross-sections shown at the bottom of FIG. 8 that the section 13 is twisted, i.e., starting from the left end the section is continuously twisted perpendicular to the plane of the sketch.

Following the description of all the device elements of the present invention, the process steps are now described:

Three mutually independent process steps are necessary. The first process step is based on the fact that the link chain 71 is drawn into the straight sectional strip in the region of a feed station 80 (FIG. 7) in such a way that the individual links 73 fill the groove profile 18 for the entire length which is to be bent.

After feeding the link chain 71 into the straight, as yet unbent sectional strip, the section is introduced into the bending machine according to FIG. 1 through 8 and there subjected to the bending process described.

For this, the section 13 is first clamped in the tension clamp 10 on one end and clamped in the clamping element 6 on the rotary table 5 on the other end. The rotary table 5 is then driven rotationally for a short distance in the direction of arrow 15 according to FIG. 2, which exerts pretensioning on the section 13 which is maintained during the entire forming process. The reason for this measure is explained in detail in the general description section.

It is further important that the rotary table is positioned in vertical altitude above the machine frame 21 using the leveling device 11 described above in such a way that the bending can take place up and down in the direction Z starting from a neutral center line. After the above-mentioned clamping of the section 19 [sic 13], the actual forming process takes place, with the drives for the movement of the rotary table 5 in the directions X, Y, Z released, whereby it is important that in the forming region 85 the traveling die roller 7 continually engages the part of the section 13 protruding away from the form block 12 positively and presses with force to prevent undesirable deformation of the cross-section of the section and especially of the groove profile 18 in the forming region 85. During the forming process it is also possible according to FIG. 2 to apply a controlled twisting motion to the section 13 in the direction of arrow 9 using the rotationally tensioned tension clamp 10.

After successful completion of the forming process, where the form block 12 has, for example, the shaping characteristic shown in FIG. 2, the section is released from the tension clamp 10; and then the front tension element 6 is released, after which the bent section 13 can be introduced into a calibration station. The calibration station 81 functions generally as described in FIG. 7.

The purpose of the calibration station is to provide for the dimensional accuracy of the groove profile 18 after successful completion of the forming process. For this, the link chain 71 is pulled out of the groove profile 18 in the direction of arrow 19 with the links 73 already causing a slight shaping of the groove profile 18.

The calibration cores 74–76 attached to the end of the link chain 71 then produce the final groove profile 18 with its requisite dimensional accuracy.

It is important for this that the section 13 is firmly tensioned against the form block 12 to prevent the groove profile 18 from being deformed or the entire section 13 from being deformed undesirably during the calibration process at the calibration station 81.

Instead of using a linked forming chain 71 which fills the groove (79) or the hollow section, another embodiment provides for the use of a plastic section or even filling the groove (79) or the hollow section with an alloy with a relatively low melting temperature (e.g., 70° Celsius), or another embodiment provides for filling the hollow section with sand.

| Legend for the Drawings |
|---|
| 1. Longitudinal slide |
| 2. Cross slide |
| 3. Vertical slide |
| 4. Shaft |
| 5. Rotary table |
| 6. Clamping element |
| 7. Die roller |
| 8. Die rail 8' |
| 9. Directional arrow (torsion) |
| 10. Tension clamp |
| 11. Leveling device |
| 12. Form block |
| 13. Metal section |
| 14. Support element |
| 15. Directional arrow (rotary table 5) |
| 16. Directional arrow (rotary table 5) |
| 17. Center (shaft 4) |
| 18. Groove profile |
| 19. Pull chain |
| 20. Directional arrow (longitudinal slide 1) |
| 21. Machine frame |
| 22. Drive motor |
| 23. Spindle |
| 24. Cross rail |
| 25. Cross rail |
| 26. Control console |
| 27. Guide rail |
| 28. Guide rail |
| 29. Cross rail |
| 30. Directional arrow |
| 31. Drive motor |
| 32. Spindle |
| 33. Guide rail |
| 34. Cross rail |
| 35. Directional arrow |
| 36. Drive motor |
| 37. Spindle |
| 38. Drive motor |
| 39. Directional arrow |
| 40. Flange |
| 41. Drive motor |
| 42. Stop block |
| 43. Shaft |
| 44. Directional arrow |
| 45. Bearings |
| 46. Directional arrow |
| 47. Slide (die roller 7) |
| 48. Transporting motor |
| 49. Directional arrow |
| 50. Slide (transporting motor-die roller 7) |
| 51. Spindle |
| 52. Directional arrow |
| 53. Side (die rail 8) |
| 54. Torsion motor |
| 55. Pivot bearing |
| 56. Directional arrow |
| 57. Pedestal |
| 58. Drive motor |
| 59. Directional arrow |
| 60. Pivot bearing |
| 61. Guide piece |
| 62. Holding fixture |
| 63. Guide block |
| 64. Spindle |
| 65. Handwheel |
| 66. Connecting element |
| 67. Rocker |
| 68. Pivot bearing |
| 69. Directional arrow |
| 70. Pivot motor |
| 71. Link chain |
| 72. Directional arrow |
| 73. Link |
| 74. Calibration core |
| 75. Calibration core |
| 76. Calibration core |
| 77. Forming center |
| 78. Forming plane |
| 79. Groove (section 13) |
| 80. Feed station |
| 81. Calibration station |
| 82. Length (link) |
| 83. Mounting flange |
| 84. Mounting holes |
| 85. Forming region |

What is claimed is:

1. In a device for cold forming a metal section having a bend line from an initially essentially straight metal section having a first end, a region to be formed, and a second end, by first pretensioning the metal section and then bending the thus pretensioned metal section, the improvement comprising:

a machine frame; a first clamp attached to the machine frame, adapted to clamp the first end of the metal section; a table; a form block mounted to the table, where the form block has an external perimeter which basically matches the bend line of the formed metal section; a second clamp attached to the table and adapted to clamp the second end of the metal section; means for mounting and controlling movement of said form block and said table along three spatially related axis (X, Y, and Z); at least one back-lash free die roller adjustably mounted, in the region to be formed, opposite the form block for controlled radial movement relative to the table for pressing the region to be formed against the form block; and means for controlling the radial movement of the die roller in controlled synchronization with the controlled three dimensional movement of said form block.

2. A device according to claim 1, wherein the die roller is positioned so that it positively engages part of the region to be formed and the part of the region to be formed not so engaged is positively engaged by the form block.

3. A device according to claim 1, further comprising the fist clamp is a tension clamp connected to a means for controllably rotating the tension clamp.

4. A device according to claim 1, further comprising (a) a stop block having a top connected to the table and a bottom connected to a first drive motor, where the stop block is adapted to rotate the table, and (b) a vertically movable (along said Z axis) leveling device attached to the stop block, and engageably attached to the end of a shaft of a second drive motor, where the second drive motor is attached to a controllably movable (along said X and Y axes) slide means, mounted on machine frame, so that the table is controllably movable along said three axes (X,Y,Z).

5. A device according to claim 4, wherein the leveling device comprises a longitudinal guide system comprising a guide piece fixedly connected to the end of the shaft to form a holding fixture, in which a guide block is vertically, movably (along said Z axis) connected, where the guide block is fixedly attached via a connecting element to stop block and where the vertical movement of the guide block is controlled by a drive motor connected via a spindle, so as to control the inclination of the table.

6. A device according to claim 4, wherein the leveling device comprises a controllably movable U-shaped rocker having opposing aligned sides on which the stop block is pivotably mounted, where the U-shaped rocker is controllably attached to a pivot motor, so as to control the inclination of the table along said X axis relative to the stop block and where control of the inclination of the rotary table along said Y axis is effected by control of the pivot position of the U-shaped rocker relative to the machine frame by the second drive motor mounted on a vertical slide.

7. A device according to claim 1, wherein the die roller is rotatably connected to the means for controlling the movement of the die roller, where the die roller movement control means comprises a radially adjustable die roller slide, adjustable relative to the rotary table, where the radially adjustable die roller slide is located on a tangentially adjustable die roller slide, adjustable relative to the table, where the tangentially adjustable roller slide is longitudinally, movably mounted to a die rail, where the die rail is U-shaped and the opposing aligned sides of the die rail are pivotably connected to the machine frame, so that the die rail can be pivotably rotated around its longitudinal axis.

8. A device according to claim 1, wherein the die roller is longitudinally movably connected to the means for controlling the movement of the die roller, where the die roller movement control means comprises a die rail adapted to controllably rotate along its longitudinal axis and where one end of the die rail is pivotably attached to the machine frame.

9. A device according to claim 8, wherein the die roller is mountably adapted to rotate around the drive axis of the shaft.

10. In a device for cold forming a metal section, containing a hollow groove and having a bend line, from an initially essentially straight metal section having a first end, a region to be formed and a second end, by first pretensioning the metal section and then bending the thus pretensioned metal section, the improvement comprising:

a machine frame; a tension clamp attached to the machine frame, adapted to clamp the first end of the metal section; a table; a form block mounted to the table, where the form block has an external perimeter which basically matches the bend line of the finished metal section; a clamping element attached to the table and adapted to clamp the second end of the metal section; means for mounting and controlling the movement of said forming block and said table along three spatially related axes (X, Y, and Z); at least one back-lash free die roller adjustably mounted, in the region to be formed, opposite the form block for controlled radial movement relative to the table for pressing the region to be formed against the form block; means for controlling the radial movement of the die roller in controlled synchronization with the controlled three dimensional movement of said form block; a link chain having a leading end and a trailing end with at least two calibration cores located on the trailing end, where the calibration cores have a progressively increasing diameter; and means for drawing the link chain through the hollow groove while the metal section is formed, where the diameter of the link chain is sufficient to prevent deformation of the groove during forming and the diameter of the calibration cores is sufficient to provide the final dimensional accuracy of the groove after forming.

11. A device according to claim 10, wherein the die roller is positioned so that it positively engages part of the region to be formed and the part of the region to be formed not so engaged is positively engaged by the form block.

12. In a device for cold forming a metal section, containing a hollow groove and having a bend line, from an initially essentially straight metal section having a first end, a region to be formed and a second end, by first pretensioning the metal section and then bending the thus pretensioned metal section, the improvement comprising:

a machine frame; a tension clamp attached to the machine frame, adapted to clamp the first end of the metal section; a table; a form block mounted to the table, where the form block has an external perimeter which basically matches the bend line of the finished metal section; a clamping element attached to the table and adapted to clamp the second end of the metal section; means for mounting and controlling movement of said form block and said table along three spatially related axes (X, Y, and Z); at least one back-lash free die roller adjustably mounted, in the region to be formed, opposite the form block for controlled radial movement relative to the table for pressing the region to be formed against the form block; means for controlling the radial movement of the die roller in controlled synchronization with the controlled three dimensional movement of said form block; a plastic section; and means for drawing the plastic section through the hollow groove while the metal section is formed, where the diameter of the plastic section is sufficient to prevent deformation of the groove during forming.

13. A device according to claim 12, wherein the die roller is positioned so that it positively engages part of the region to be formed and the part of the region to be formed not so engaged is positively engaged by the form block.

* * * * *